US007704011B2

(12) United States Patent
Marshall

(10) Patent No.: US 7,704,011 B2
(45) Date of Patent: Apr. 27, 2010

(54) STRUCTURAL MODULE

(75) Inventor: Richard Granville Marshall, Dublin (IE)

(73) Assignee: Permavoid Ltd, Leicester (GB)

( * ) Notice: Subject to any disclaimer, the term of this patent is extended or adjusted under 35 U.S.C. 154(b) by 238 days.

(21) Appl. No.: 11/701,758

(22) Filed: Feb. 2, 2007

(65) Prior Publication Data

US 2007/0186499 A1 Aug. 16, 2007

Related U.S. Application Data

(62) Division of application No. 10/344,775, filed as application No. PCT/IE01/00106 on Aug. 17, 2001, now abandoned.

(30) Foreign Application Priority Data

Aug. 17, 2000 (IE) ..... S2000/0648

(51) Int. Cl.
*E01C 5/00* (2006.01)

(52) U.S. Cl. ..... 404/29; 404/34; 404/41

(58) Field of Classification Search ..... 404/18, 404/27, 28, 29, 34, 40, 41, 45
See application file for complete search history.

(56) References Cited

U.S. PATENT DOCUMENTS

| | | | | | |
|---|---|---|---|---|---|
| 69,297 | A | * | 9/1867 | Stafford | 404/39 |
| 1,636,114 | A | * | 7/1927 | Streator | 404/29 |
| 2,392,551 | A | | 1/1946 | Roe | |
| 3,881,571 | A | | 5/1975 | Moulton | |
| 4,678,192 | A | | 7/1987 | Campbell | |
| 4,850,739 | A | * | 7/1989 | Gargollo | 404/41 |
| 5,373,661 | A | | 12/1994 | Furukawa | |
| 5,437,698 | A | | 8/1995 | Furukawa | |
| 5,509,244 | A | | 4/1996 | Bentzon | |
| 5,549,418 | A | * | 8/1996 | Devine et al. | 405/258.1 |
| 5,735,640 | A | * | 4/1998 | Meyer et al. | 405/302.7 |
| 5,916,104 | A | | 6/1999 | Lucenet et al. | |
| 6,050,044 | A | | 4/2000 | McIntosh | |
| 6,146,054 | A | * | 11/2000 | Tessonneau | 405/258.1 |
| 6,688,808 | B2 | * | 2/2004 | Lee | 404/40 |
| 6,736,569 | B2 | | 5/2004 | Lee | |
| 6,739,797 | B1 | * | 5/2004 | Schneider | 404/35 |
| 7,344,334 | B2 | * | 3/2008 | Thorkelson | 404/29 |
| 7,429,144 | B1 | * | 9/2008 | Lai | 404/40 |
| 2002/0090261 | A1 | * | 7/2002 | Sansalone | 404/17 |
| 2005/0224690 | A1 | * | 10/2005 | Hobbs | 249/2 |

FOREIGN PATENT DOCUMENTS

| | | | |
|---|---|---|---|
| CH | 631 764 | * | 8/1982 |
| EP | 0943737 A1 | | 9/1999 |

* cited by examiner

*Primary Examiner*—Gary S Hartmann
(74) *Attorney, Agent, or Firm*—Thomas A. Runk; Fulwider Patton LLP

(57) ABSTRACT

A sub-base layer for use in construction, comprises a plurality of connected substantially cuboid modules each having spaced-apart, substantially parallel top and bottom walls joined by a peripheral sidewall defining an enclosed volume. The connection between the modules is effected by a plurality of tie members which prevent lateral movement of the modules relative to one another. The layer is particularly useful as a lightweight replacement for aggregate sub-base layers in foundations, roadways, pavement, carparks, and the like.

20 Claims, 12 Drawing Sheets

STRUCTURAL MODULE

RELATED APPLICATIONS

This is a divisional of Ser. No. 10/344,775, having a §371 filing date of Feb. 18, 2003, now abandoned which is a U.S. national phase application claiming priority from PCT/IE01/00106 having an international filing date of 17 Aug. 2001, which was published in the English language as WO 02/14608 on 21 Feb. 2002, and which claims priority from Irish patent application S2000/0648 filed 17 Aug. 2000.

TECHNICAL FIELD

This invention relates to a structural module for use, for example, in the creation of a structural sub-base layer within a pavement, building foundation or soft landscaping area, and to sub-base layers and structures.

BACKGROUND ART

Traditional forms of sub-base layers have comprised particulate materials (usually natural aggregates) to provide the necessary structural and drainage characteristics within a pavement construction. For example, in GB2294077 a bed of gravel is used.

DISCLOSURE OF INVENTION

The invention provides, in one aspect, a sub-base layer for use in construction, said layer comprising a plurality of connected, substantially cuboid modules each comprising spaced-apart, substantially parallel top and bottom walls joined by a peripheral sidewall defining an enclosed volume, the connection between said modules being effected by a plurality of tie members which prevent lateral movement of the modules relative to one another.

The sub-base layer according to the invention provides an inexpensive, lightweight, and strong layer with particular application as a replacement for aggregate layers in foundations, pavements, roadways, carparks, and the like. Unlike aggregate layers, the sub-base layer of the invention provides an inherently level base on which to lay further materials.

In a further aspect the invention provides a sub-base structure comprising at least two sub-base layers according to the invention, said layers being disposed one above the other, and a plurality of reinforcing struts connected between the layers.

The invention also provides a structural module comprising spaced-apart, substantially parallel top and bottom walls joined by a peripheral sidewall defining an enclosed volume, a plurality of pillars extending within said enclosed volume substantially vertically between the top and bottom walls to resist vertical crushing of the module, and a network of bracing members extending between the pillars within said enclosed volume to resist geometric deformation of said module in a horizontal plane, said top and bottom walls, said sidewall and said network being apertured to allow fluid flow both vertically and horizontally through said module.

An advantage of the invention is that the modules can be fabricated off-site and a sub-base layer built up rapidly on-site from the pre-fabricated modules.

The modules according to the invention can be used to form a non-particulate sub-base layer under any type of surface, permeable or impermeable, porous or non-porous, and in both trafficked and non-trafficked situations, to provide the dual function of structural layer and shallow storage reservoir. Inherent within the structure is a system of connectors which eliminates the potential for short-term and long-term creep of the sub-base layer. Further, their voided internal structure (typically >90%) enables the modules to be used as a lateral drainage system with integral flow control and water treatment capabilities.

The modules can include infill media to provide biological and/or chemical treatment of water stored in or passing through the modules. Further, they can be used for infiltration and attenuation incorporating geotextiles and geomembranes to suit the application.

While the primary application of the modules is envisioned to be in the construction of structural sub-base layers as described above, other uses are possible.

A non-exclusive list of examples of other uses might include the following, all of which are provided in the scope of the invention:

a) Load bearing systems in general for fluid containment, transportation and/or treatment;

b) Lightweight load distribution systems for weak subgrades, capping layers and floating pontoons;

c) Structural retaining wall systems;

d) Lightweight raft formations for foundations;

e) Channel line drainage systems f) Temporary structural formwork systems;

g) Acoustic and thermal insulation systems;

h) Structural cavity forming systems;

i) Temporary structural flooring and seating systems;

j) Leak detection systems;

k) Hydraulic flow control and energy dissipation systems;

l) Cable ducting and troughing systems;

m) Air conditioning ventilation formers;

n) Raised flooring systems having integral drainage, particularly for use in "wet" industrial environments.

In a further aspect the invention provides a tie member for connecting a pair of structural modules, said tie member comprising an elongate member having a substantially constant cross sectional outline of a pair of adjoined symmetrically identical trapezoids connected along the shorter of their parallel sides.

BRIEF DESCRIPTION OF THE DRAWINGS

An embodiment of the invention will now be described, by way of example, with reference to the accompanying drawings, in which.

DESCRIPTION OF PREFERRED EMBODIMENTS

Figure 1:
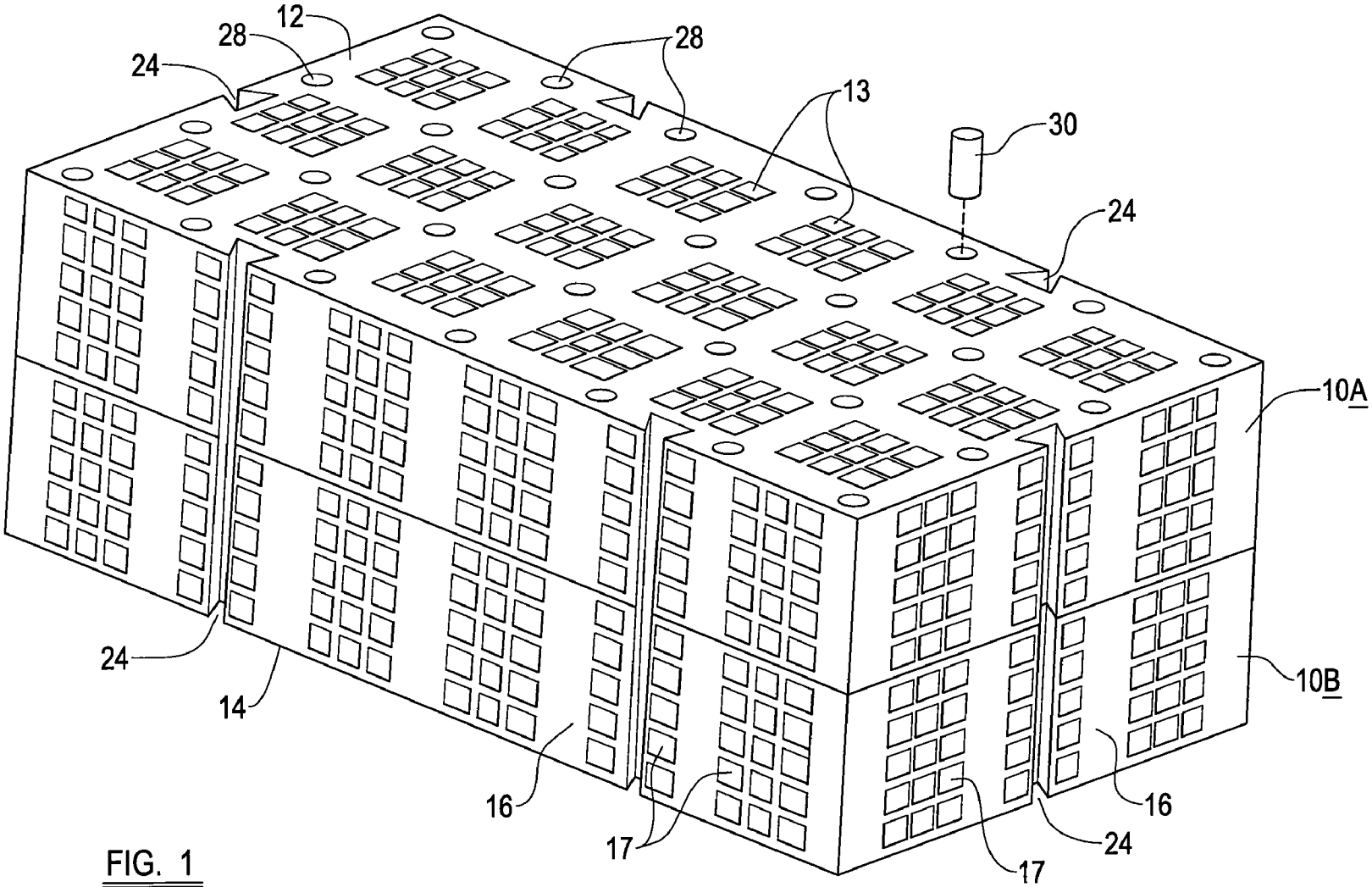
FIG. 1 is a perspective view of a structural module according to the embodiment of the invention.
Figure 2:
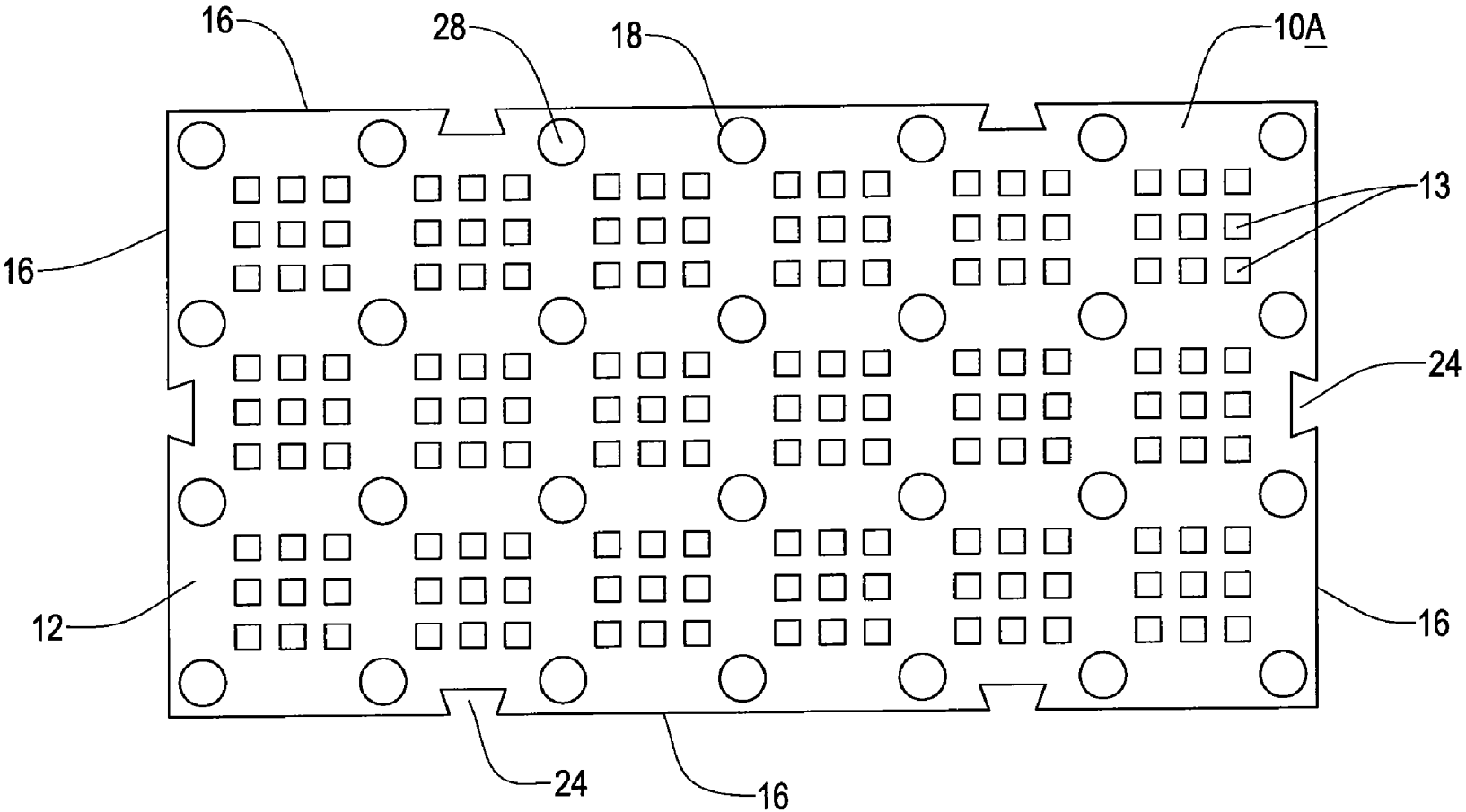
FIG. 2 is a plan view of the module of FIG. 1.

In the present specification expressions of orientation such as top, bottom, vertical, etc., are used for convenience only and refer to the normal orientation of the module as seen in the accompanying drawings. However, such expressions are not to be regarded as limiting the orientation of the module in use, and indeed, as will be described below, sub-base structures according to the invention can include modules disposed on their sides or ends, at right angles to their "normal" orientation.

Referring to the drawings, a structural module 10 comprises spaced-apart, substantially parallel top and bottom walls 12, 14 joined by a substantially vertical peripheral sidewall 16 defining an enclosed volume. In the present embodiment the top and bottom walls 12, 14 are rectangular so that externally the module 10 has the general shape of a rectilinear box. The top and bottom walls have a large number of clustered rectangular apertures 13 (those in the bottom wall are not visible in the figures but are arranged the same as those in the top wall), and likewise the peripheral sidewall 16 has a large number of clustered rectangular apertures 17. These apertures 13, 17 allow fluid flow into and out of the module 10 in any direction, vertical or horizontal.

Figure 8:
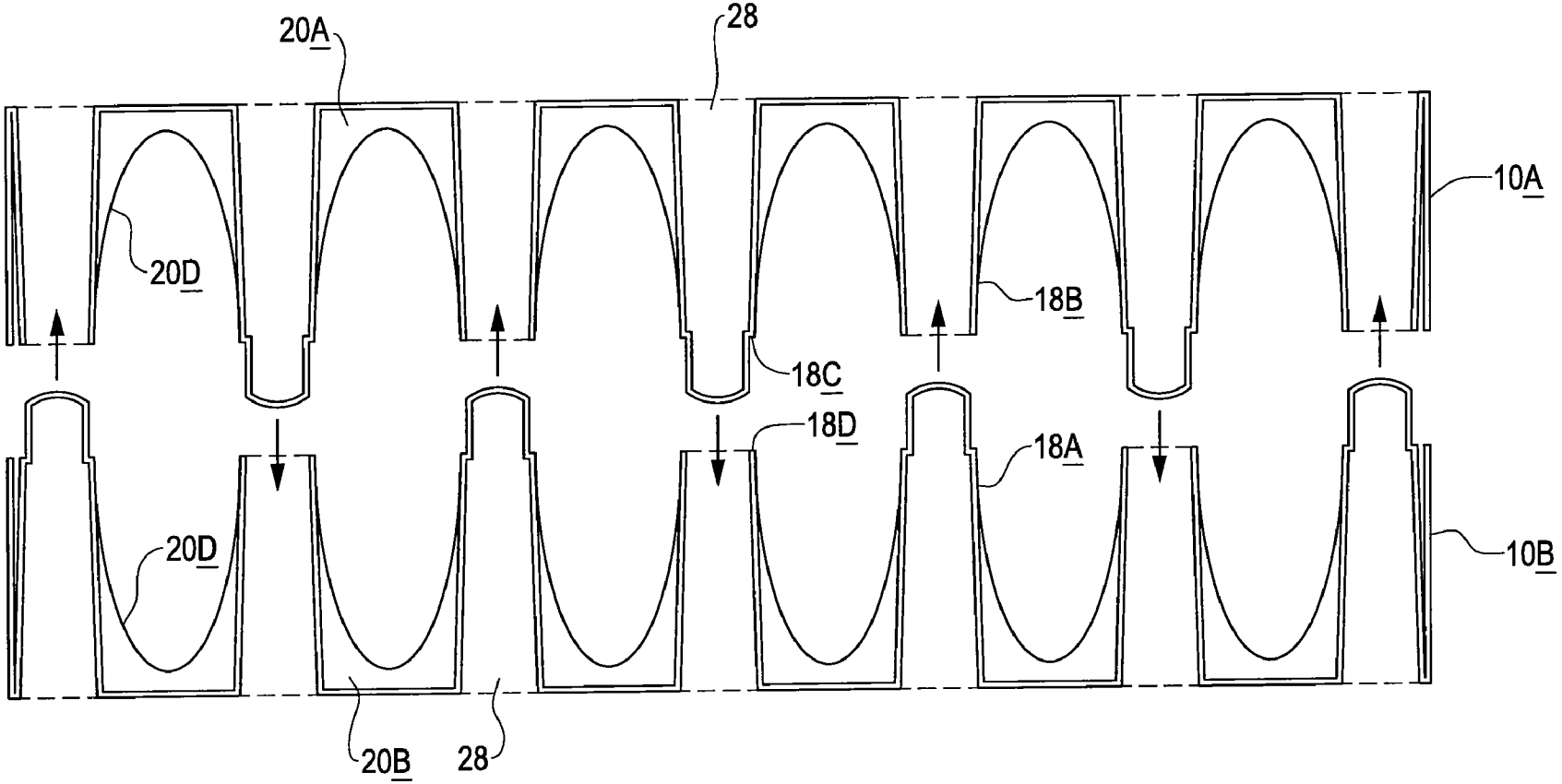
FIG. 8 is a view, similar to FIG. 5, showing the two halves from which the complete module is assembled.
Figure 9:
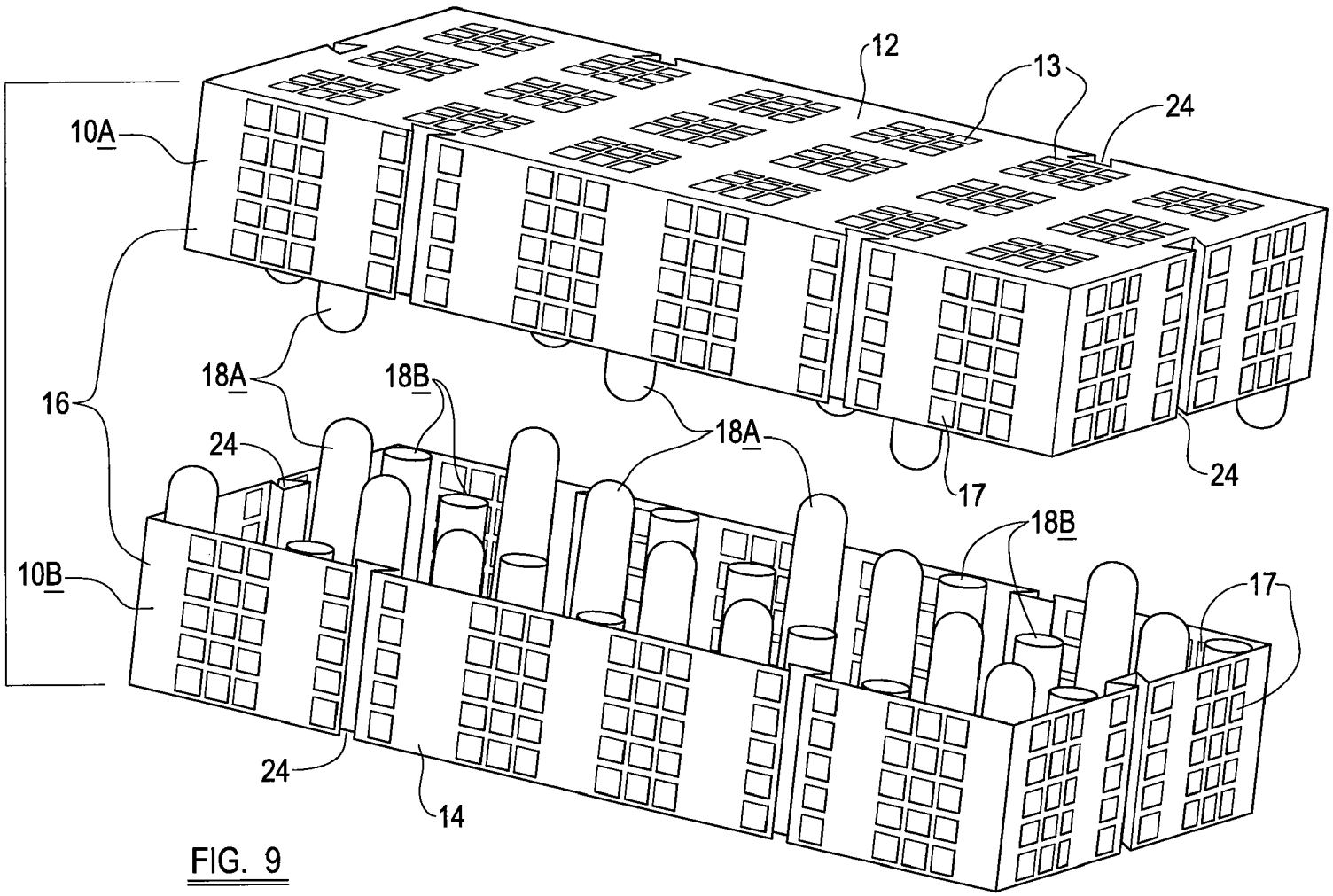
FIG. 9 is a perspective view of the two halves of FIG. 8.
Figure 10:
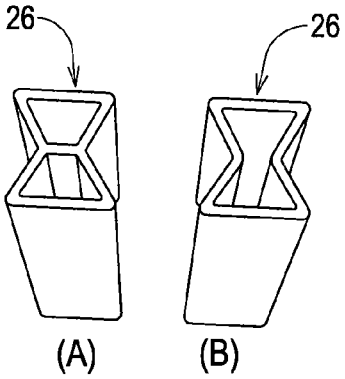
FIGS. 10A and 10B are perspective end views of two alternative tie members according to the invention.

Internally, the module 10 contains a rectangular array of hollow, generally cylindrical pillars 18 extending vertically between the top and bottom walls 12, 14 to resist vertical crushing of the module 10. In this embodiment the module 10 is assembled from two substantially identical integral components 10A, 10B (see especially FIGS. 8 and 9) moulded from a rigid plastics material and which are fitted one inverted on top of the other. Each pillar 18 thus comprises two half-pillars or male and female parts 18A, 18B respectively, one part being integral with one component 10A or 10B and the other part being integral with the other component 10A or 10B. The male parts 18A alternate with the female parts 18B in each component 10A and 10B such that when the two components are fitted together the male parts 18A of each component enter the respective female parts 18B of the other component to form the complete pillars 18. To avoid over-insertion of the male parts into the female parts, and to maintain the top and bottom walls 12 and 14 at their correct separation, each male part has a shoulder 18C which abuts against the open end 18D of the respective female part when the components 10A and 10B are fully engaged.

Figure 4:
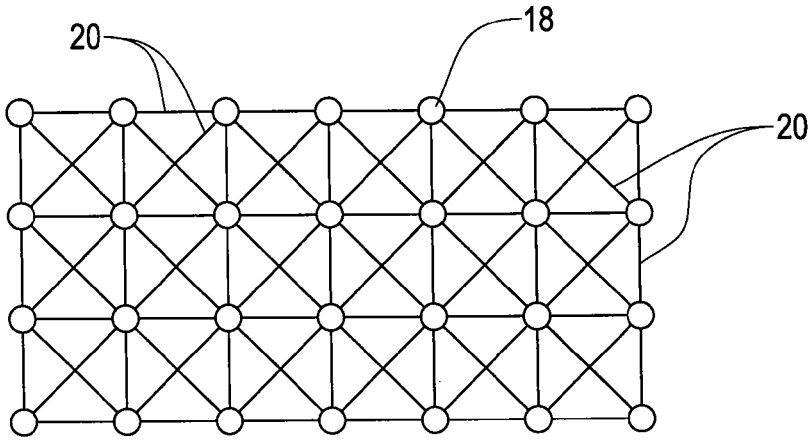
FIG. 4 illustrates the location of parabolic bracing webs extending between the pillars of the module.
Figure 5:
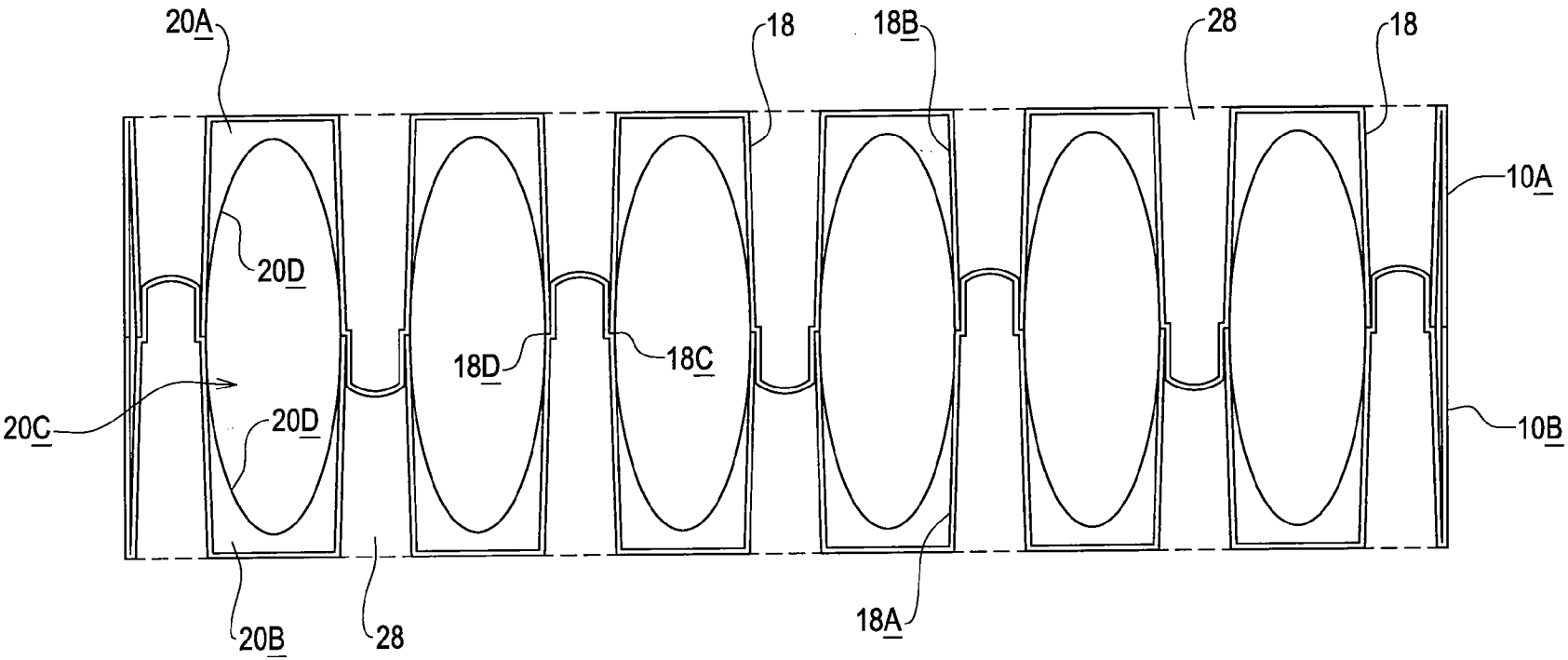
FIG. 5 is a vertical cross-section of the module taken on line 5-5 of FIG. 3.

Internally, the module 10 also contains a network of bracing members 20, 22 to resist geometric deformation of the module in a horizontal plane. The bracing members 20, whose locations are shown in FIG. 4, extend directly or diagonally between adjacent pillars 18 and comprise vertical webs having apertures 20C to allow fluid flow horizontally through the module 10 in any direction (since the webs 20 are orientated vertically they do not obstruct fluid flow in the vertical direction). Each web 20 is formed of upper and lower halves 20A, 20B integral with the upper and lower components 10A, 10B respectively, and have facing concave edges 20D defining the apertures 20C. In this embodiment the edges 20D are parabolic.

Figure 3:
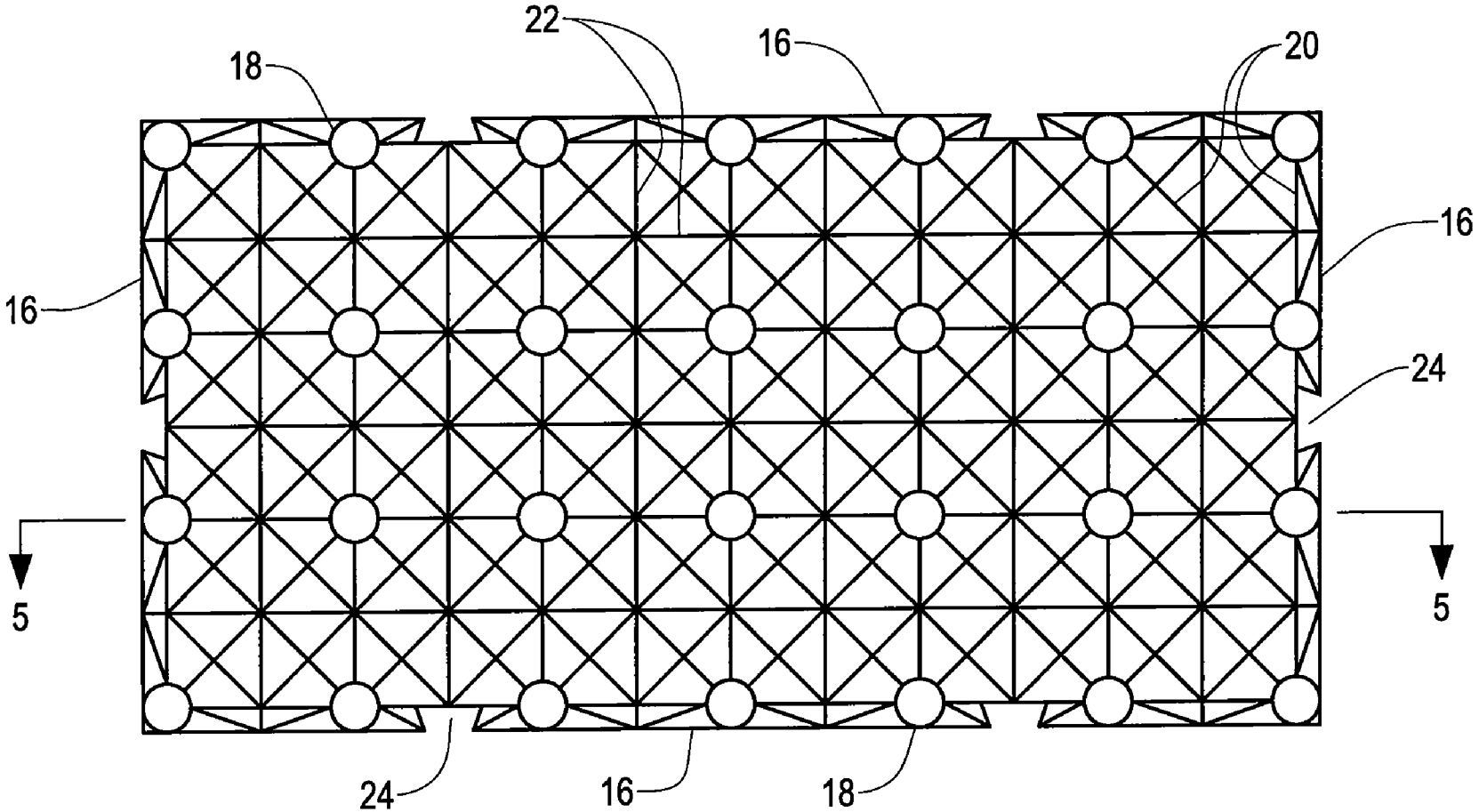
FIG. 3 is a horizontal cross-section through the module in a plane parallel to the top wall of the module.

The bracing members 22 serve to break down voids within the box. As viewed from above in FIG. 3, they extend substantially normally between the bracing members 20 and supplement the bracing effect of the latter. As viewed in FIG. 3, members 22 are 5 mm thick and extend upward from the base (in a direction normal to the page) by 3 mm.

Figure 7:
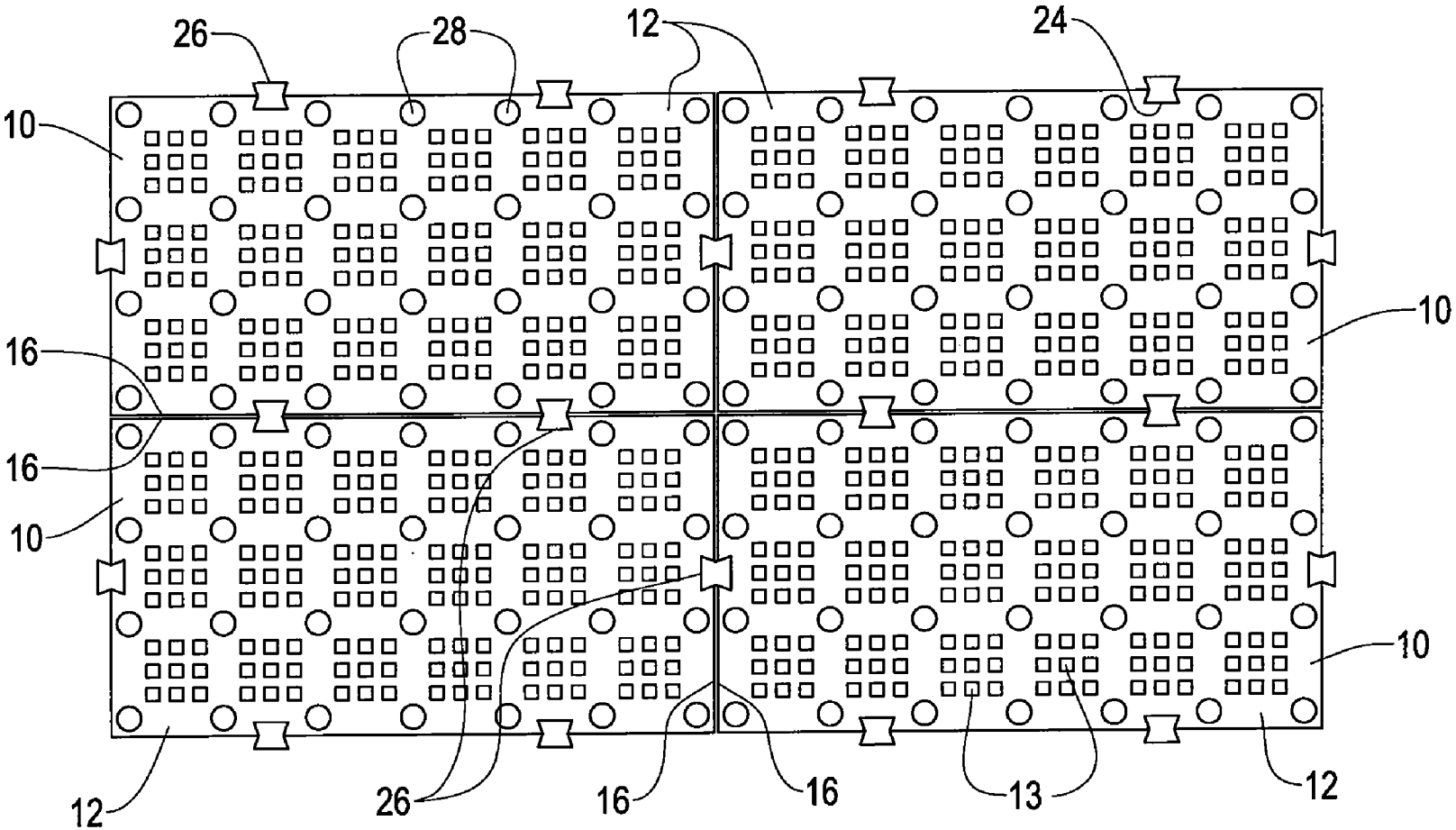
FIG. 7 is a plan view of a plurality of modules of FIG. 1 connected into a continuous sub-base layer by tie members.

To allow a plurality of modules 10 to be rigidly connected together to form a layer of such modules, for example, for use as a structural sub-base layer, the peripheral sidewall 16 comprises a plurality of substantially vertical keyways in the form of dovetail slots 24 each for slidably receiving a respective reinforced tie member 26 (FIGS. 10-13) having a "bow tie" cross-section. As seen in FIG. 7, when connecting two modules 10 together, a single tie member 26 slidably engages two opposing keyways 24 in the two modules. This connector eliminates the potential for short-term and long-term creep of the system.

As seen in FIG. 7, the rectangular shape of the modules 10, in plan view, allows the modules to be disposed closely adjacent one another along their peripheral sidewalls 16 to form an extensive, substantially continuous layer of modules of any desired area. That is to say, the layer of modules is without significant gaps between the modules. However, the same effect can be obtained using modules of different geometrical shape in plan view, for example, the modules could be hexagonal or triangular. Either alternative will allow an extensive, substantially continuous layer of modules to be built up, with connectors eliminating short-term and long-term creep.

Finally, to allow a layer of connected modules to be built up which is more than one module thick, the ends of the pillars 18 are open at the top and bottom walls, as seen at 28. This allows reinforced pegs 30 (FIG. 1) to be inserted partially into the open pillar ends 28 in the top wall 12 of one module and partially into the open pillar ends 28 in the bottom wall 14 of a module overlying and in register with the first module, to maintain them against relative lateral displacement.

An example of a module 10 made as above had overall dimensions approximately 710 mm long×355 mm wide×250 mm deep. The pillars 18 were spaced on approximately 105 mm centres, had an outside diameter of about 40 mm and a thickness of about 5 mm. All walls 12, 14 and 16, and webs 22 and 22, were about 3 mm thick.

Figure 6:
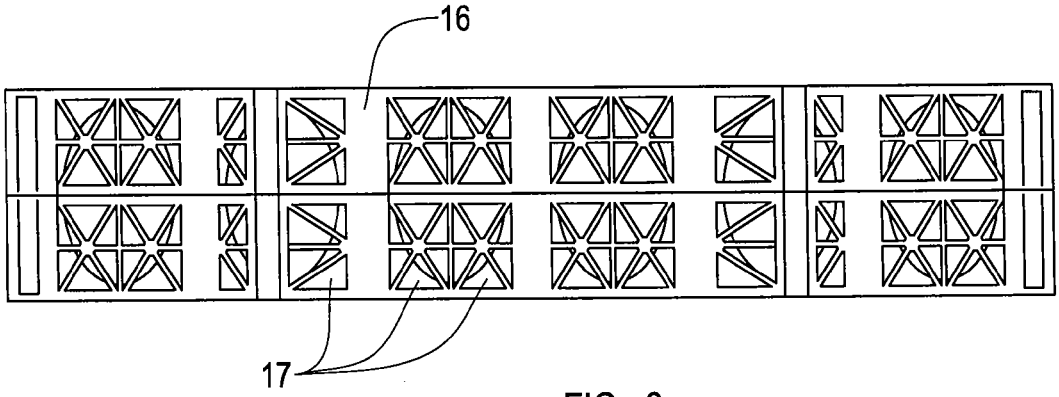
FIG. 6 is a side elevation of an alternative embodiment of module to that shown in FIG. 1.

FIG. 6 shows an alternative embodiment of a module according to the invention, in which the pattern of apertures 17 in the sidewall 16 is more open, to allow greater lateral fluid flow between adjoining modules and out of the outermost edges of a sub-base layer formed of a plurality of adjoined modules. The larger apertures can be incorporated without significantly compromising the strength of the modules due to the fact that when used as a structural sub-base the lateral compressive forces are significantly less than the vertical forces, and most of the vertical strength is derived from the pillars rather than the sidewalls.

Figure 11:
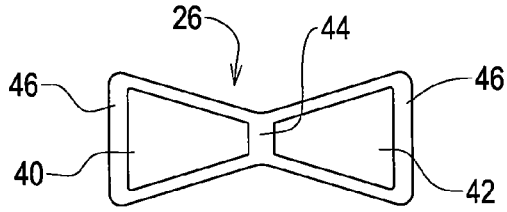
FIG. 11 is a plan view of the tie member of FIG. 10A.

FIGS. 10A and 11 show an embodiment of tie member in perspective view from one end, and in plan view, respectively. The tie member 26 has a substantially constant "bow-tie" cross-section, i.e. the shape is that of two symmetrically identical trapezoids 40,42, sharing a common side 44, which is the shorter of the two parallel sides 44,46 of each trapezoid.

The tie member of FIG. 10B is identical in outline, but the shared wall is omitted.

Figure 12:
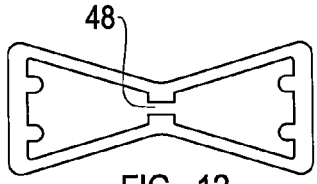
FIG. 12 is a plan view of a further alternative tie member according to the invention.
Figure 13:
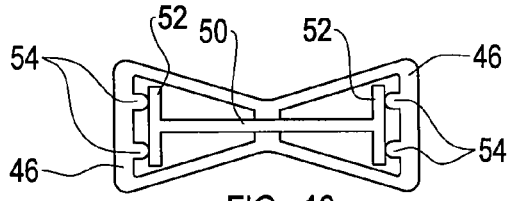
FIG. 13 is a plan view of the tie member of FIG. 12 with a reinforcing I-bar in place.

FIG. 12 shows the cross-section of a further embodiment of tie-member in which the shorter shared side of the trapezoids has a gap 48 to accommodate a reinforcing I-bar section of steel 50 (FIG. 13). The ends 52 of the I-bar abut against a pair of ridges 54 running down the longer of each of the parallel trapezoid sides 46, to hold the I-bar firmly in place in the tie member.

Figure 14:
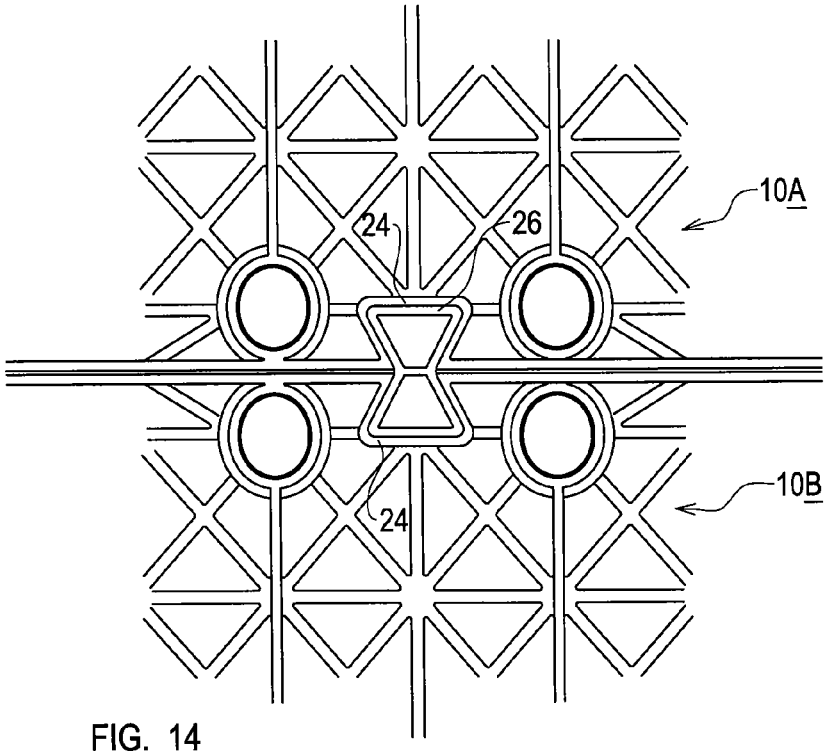
FIG. 14 is a detail of two modules connected by the tie member of FIG. 10A.

FIG. 14 shows the tie member 26 of FIG. 10A in position in a pair of keyways 24 to hold two adjacent modules 10*a*, 10*b* in position relative to one another.

Advantageously the keyways 24 which extend through the height of the peripheral sidewall (see FIG. 1, for example), may incorporate a slight taper narrowing from the top and bottom surfaces towards the centreline. In this way, a pair of tie members, each having a length equal to the height of one of the halves making up the module, may be inserted from the top and from the bottom. As they move into the keyways, the taper grips them more tightly, and thereby holds them firmly in place without allowing any play between the tie members and the modules.

Figure 15:
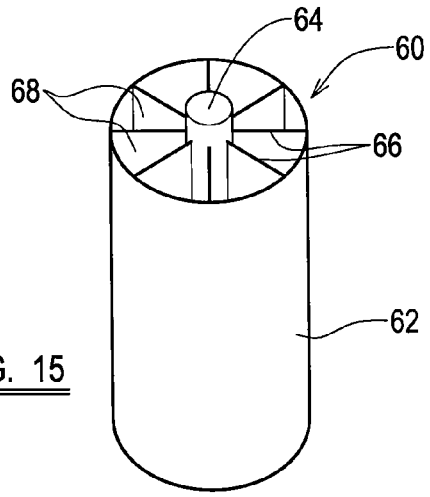
FIGS. 15 and 16 are perspective views of a reinforcing strut used in the sub-base structure according to the invention.
Figure 16:
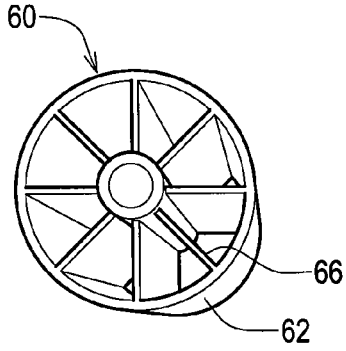

Instead of stacking modules directly on top of one another as previously described, reinforcing and separating struts can be used to define a void between layers of modules in a sub-base structure. A reinforcing strut is shown in FIGS. 15-20. As seen in FIGS. 15 and 16, the strut 60 comprises a generally hollow cylindrical body 62 having a central support post 64 therein which extends above and below the ends of the cylinder. A plurality of planar supports 66 extend radially from the support post 64 to the body 62. These planar supports define generally wedge-shaped hollows 68 running through the length of the strut, allowing fluid flow through the strut.

Figure 17:
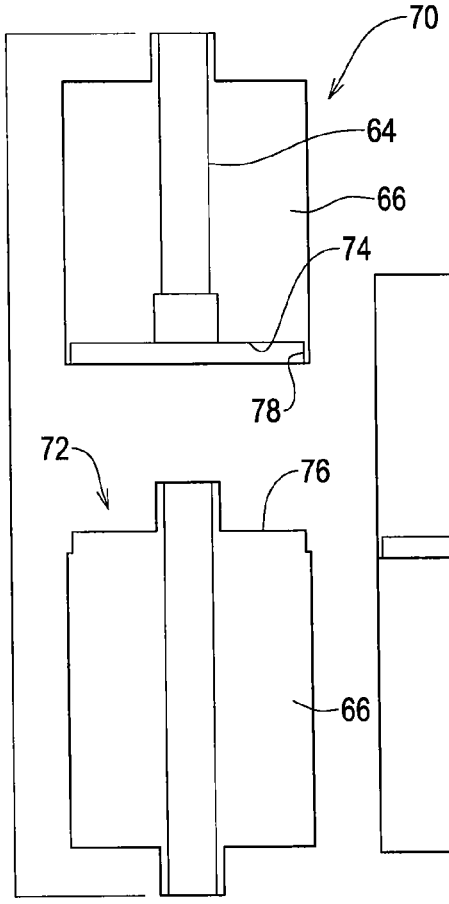
FIG. 17 is an exploded sectional elevation of the upper and lower halves of the strut of FIGS. 15 and 16.
Figure 18:
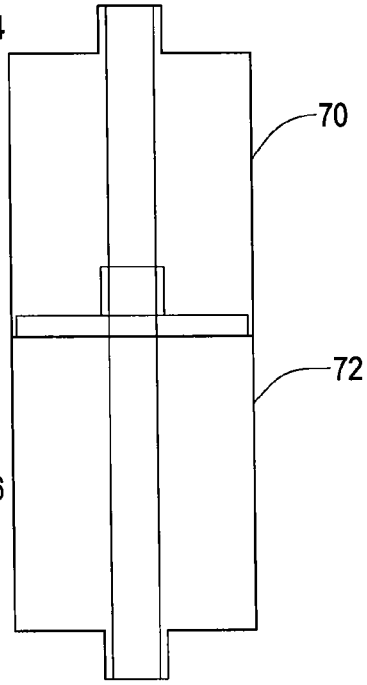
FIG. 18 is a sectional elevation similar to that of FIG. 17, showing the two halves assembled together.
Figure 19:
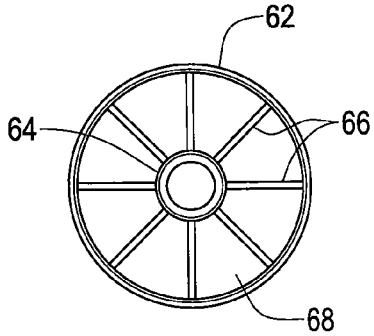
FIGS. 19 and 20 are plan views of the upper and lower halves respectively of the strut.
Figure 20:
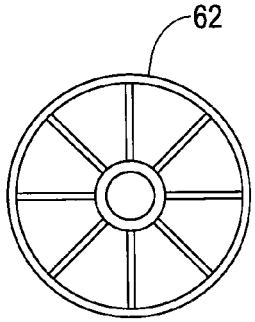

As seen in FIGS. 17 and 18, the strut is formed in two halves 70,72 (shown in plan view in FIGS. 19 and 20). The planar surfaces within upper half 70 terminate at an end edge 74 against which the end edge 76 of the corresponding planar surface in the lower half 72 abuts. This upper end edge 76 fits into a collar 78 of the upper half 70, thereby enabling the two halves to fit together as seen in FIG. 18.

By manufacturing the strut in two halves, the length of the strut (and hence the distance between the layers separated by the strut) can be varied. Thus, only the upper half could be used, making a male connection with the module above it and a female connection with a peg fitted into the module below it, or the full strut (FIG. 18) could be used to make a male connection with the modules above and below. It will be appreciated that the strut can be extended as required.

The wedge-shaped hollows 68 can advantageously be used to retain infill or filtration media of any suitable type (e.g. simple physical strainers, or chemical or biological purifiers), to treat water or other liquid passing down through the strut from an upper module to a lower module.

Figure 21:
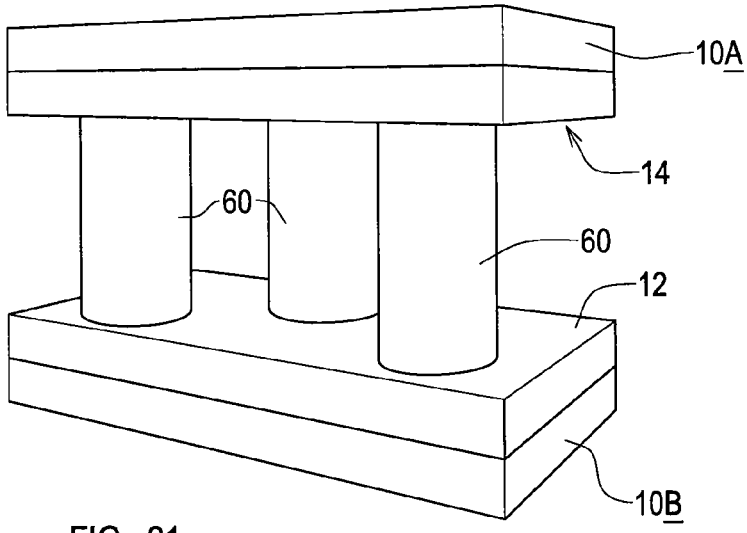
FIG. 21 is a perspective view of two modules separated by reinforcing struts.
Figure 22:
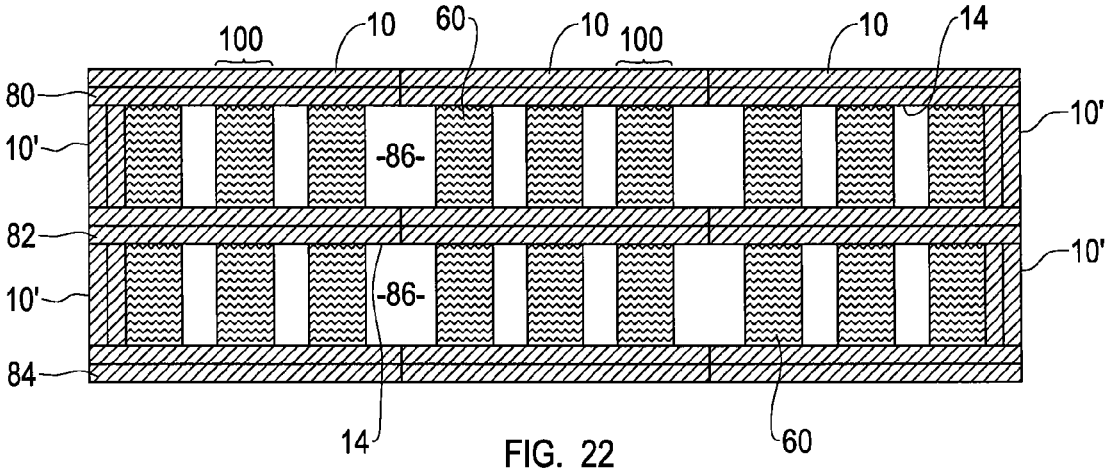
FIG. 22 is a sectional elevation of a sub-base structure according to the invention.

FIG. 21 illustrates how the struts 60 may be disposed between an upper module 10*a*, and a lower module 10*b* (both shown in simplified form as a pair of connected box sections) separated by a plurality of struts 60. In practice, rather than just two modules, a more extensive structure will be formed from two or more stacked layers (such as the layer of FIG. 7 extended outwards), with struts 60 between these layers. FIG. 22 shows such a structure.

As seen in FIG. 22, three sub-base layers 80,82,84 each comprising a plurality of modules 10 connected by tie members (not shown) are disposed one above the other. Struts 60 separate the upper layer 80 from the middle layer 82, and the middle layer 82 from the lower layer 84. The structure is shown in section but will extend in three dimensions, with struts disposed periodically across the extent of each layer.

The edges of the structure are bounded by a series of modules 10' which are identical to the modules 10 of the layers but which are disposed on their sides. The modules and struts are dimensioned so that the height of the strut equals the width of a module, i.e. when disposed on their sides, modules 10' have a "height" which exactly fills the gap between the peripheries of the layers. In this way a "cage" structure can be created which defines an internal void 86 (or with more than two layers a number of such voids 86) in which the struts are located.

The cage provides a large open volume to receive waste water or other fluids, and the structure is sufficiently strong to support constructions such as building foundations and paved surfaces.

The structure will generally be disposed in the earth so that the modules 10' are prevented from falling outwards by the lateral inward pressure exerted by the surrounding soil. The positions of the struts are chosen so that the modules 10' cannot move into the cage since they abut against struts 60, and in this way the cage structure is maintained in use.

Figure 23:
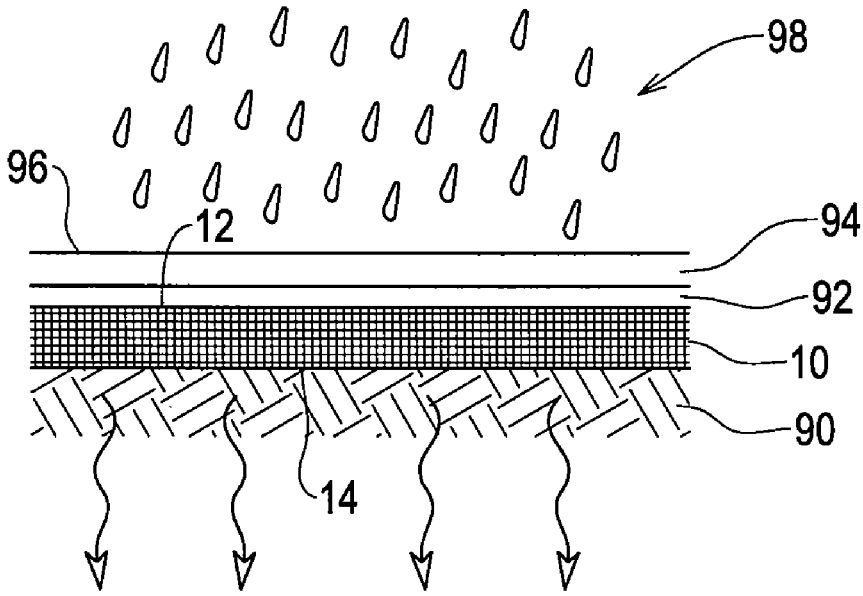
FIG. 23 is a schematic view of a sub-base layer according to the invention used in an infiltration mode.

Referring to FIG. 23, a first application of the sub-base layer according to the invention is shown. A sub-base layer of modules 10 is placed on a sub-grade 90. This sub-base layer takes the place of aggregate such as gravel which is often used as a sub-base layer. Surface layers 92,94 are then laid on top of the modules in conventional manner to provide a finished surface 96 which receives precipitation 98 and surface water.

The top wall 12 and bottom wall 14 of the modules are covered by a pervious geotextile which acts to filter water entering the modules and to prevent soil fines from migrating through the modules. Although the geotextile is preferably provided above and below the layer, one or both of these geotextiles may be omitted as appropriate.

If the surface layers 92,94 are both pervious, then precipitation 98 falling on the surface can seep through the surface layers into the sub-base layer and from there into the underlying sub-grade 90. In addition to providing structural strength and a level top surface, the sub-base layer provides a temporary storage tank for holding and dissipating large volumes of water. It also enables water to be redistributed away from localised areas where a lot of water collects.

Furthermore, by including infill media in the modules, filtration and/or chemical or biological treatment of the water may be achieved before it reaches the local water table or watercourses via the sub-grade.

The single layer of modules 10 shown in FIG. 23 can be replaced by a number of stacked layers or by a multi-layer sub-base structure of the type shown in FIG. 22.

If one or more of the surface layers is impervious, then water can arrive at the modules laterally from a section of the layer which lies under pervious layers, or 10 via pipes, gullies and the like.

Figure 24:
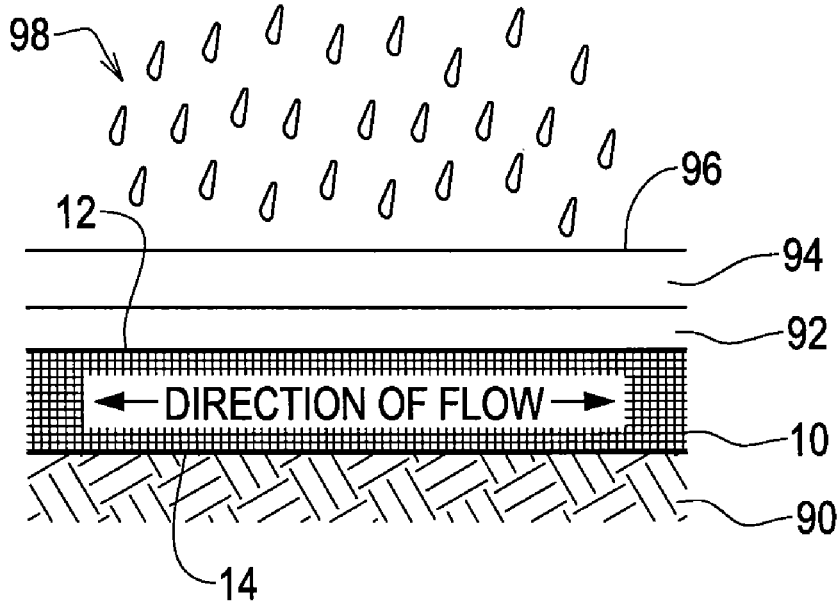
FIG. 24 is a schematic view of a sub-base layer according to the invention used in an attenuation mode.

FIG. 24 shows another application, in which the modules 10 are again disposed in a layer above a sub-grade 90 and below surface layers 92,94 which may be pervious or impervious as discussed above. In this embodiment, the bottom wall 14 is covered by an impermeable geomembrane which prevents water from flowing out of the bottom of the layer. Instead, the layer acts to store water and channel it to a suitable drainage structure by lateral drainage. This arrangement may be required if local geological conditions or environmental regulations preclude the direct drainage of water into the sub-grade. The top surface 12 can also be covered by an impermeable geomembrane (if water arrives via conduits, pipes or gullies) or by a permeable geotextile (if water is to seep directly into the modules from above). Again, the single layer of modules can be replaced by a multi-layer structure.

Referring back to FIG. 22, a further modification of the structure can be described for use in such applications as those described for FIGS. 23 and 24. The cage structure, in this variation, is covered above and below by a permeable geotextile (not shown). Water arrives into the structure by seeping from above into the top layer 80 of modules 10. The bottom wall 14 of this top layer is covered externally by an impermeable membrane (not shown) which is held in place by being clamped between the struts 60 and the modules 10. This prevents water from draining directly through the apertures 13 (FIG. 1) in the bottom wall 14 into the void 86.

The impermeable membrane is provided with apertures in the region 100 where it is covered by the cylindrical struts abutting against the bottom wall 14. These apertures in the impermeable membrane provide the sole means of water draining from the upper layer 80, i.e. all of the water draining from the upper layer does so via the hollow struts. Water drains through the wedge-shaped channels in the struts which are filled with filtration and/or water treatment infill media. The treated or filtered water reaches the middle layer 82 from where it can drain into the bottom layer either from the bottom wall 14 of the middle layer 82 or via the struts 60 supporting the middle layer 82.

The bottom wall of the middle layer may be provided with a similarly apertured impermeable membrane, in which case the lower set of struts can provide a second stage treatment. In this way, a coarse filtration medium could be provided in the upper set of struts and a fine filtration medium in the lower set of struts. Water entering the top layer 80 would be coarsely filtered and could flow at high rates into the middle layer 82. Since the only egress from the middle layer to the bottom layer 84 is through the lower set of struts and since these struts may be provided with low flow-rate fine filters, large volumes of water could be temporarily held in the middle layer and in the void 86 between the middle and upper layers (this void being in free communication with the apertures in the top wall of the middle layer modules). After collecting in the middle layer and upper void, the coarsely filtered water can then seep more slowly through the fine filters into the lower layer 84 and the void 86 between the lower and middle layers, before finally seeping out of the lower layer into the sub-grade, or laterally from the lower layer through drainage channels (not shown). A combination of filters and chemical/biological treatment media could also be used as required.

The invention is not limited to the embodiments described herein which may be modified or varied without departing from the scope of the invention.

The invention claimed is:

1. A vehicular trafficked pavement structure comprising:

a sub-base layer, said sub-base layer including a plurality of connected, substantially cuboid modules each including spaced-apart, substantially parallel top and bottom walls joined by a peripheral sidewall defining an enclosed substantially hollow volume, the walls comprising apertures to permit the flow of fluid through each of the modules and between the modules, the connection between said modules being effected by a plurality of tie members which prevent lateral movement of the modules relative to one another, the sub-base layer including a structural layer, the pavement structure including a sub-grade where the sub-base layer is disposed directly on the sub-grade; and a plurality of surface layers separate from the sub-base layer and not comprising modules, said plurality of surface layers being disposed directly on top of the sub-base layer to provide a finished surface to support vehicular traffic.

2. A pavement structure according to claim 1, wherein each module is formed from a top half which includes said top wall and the upper part of said peripheral sidewall, and a bottom half defining said bottom wall and the lower part of said peripheral sidewall.

3. A pavement structure according to claim 2, wherein the top and bottom halves are each provided with a set of half-pillars extending within the enclosed volume towards one another, whereby the two sets of half-pillars co-operate with one another to form pillars extending between the top and bottom walls to resist vertical crushing of the module.

4. A pavement structure according to claim 2, wherein the top and bottom half are two substantially identical integral plastics moulded components which are fitted one inverted on top of the other.

5. A pavement structure according to claim 1, wherein the height of the peripheral sidewalls is substantially less than both the width and the length of the top and bottom walls.

6. A pavement structure according to claim 3, wherein each module further comprises a network of bracing members extending between the pillars within said enclosed volume to resist geometric deformation of said module in a horizontal plane.

7. A pavement structure according to claim 6, wherein said sidewall and said network are apertured to allow fluid flow both vertically and horizontally through said module.

8. A pavement structure according to claim 1, further comprising an infill medium disposed within the enclosed volume of one or more of said modules.

9. A pavement structure according to claim 8, wherein said infill medium is a medium which provides biological and/or chemical treatment of water stored in or passing through the modules.

10. A pavement structure according to claim 1, wherein said tie members are adapted to clamp together abutting sidewalls of a pair of adjacent modules.

11. A pavement structure according to claim 10, wherein the peripheral sidewall of each module is provided with a keyway for receiving one half of a tie member.

12. A pavement structure according to claim 11, wherein said keyway is in the form of a female dovetail groove extending through the height of the sidewall.

13. A pavement structure according to claim 12, wherein each tie member is an elongate member having a cross sectional outline of a pair of adjoined symmetrically identical trapezoids connected along the shorter of their parallel sides.

14. A pavement structure according to claim 13, wherein an elongate reinforcing member is disposed within the interior of the tie member.

15. A pavement structure according to claim 1, wherein a geomembrane or geotextile is disposed at least one of above and below the sub-base layer.

16. A pavement structure according to claim 1, wherein the sub-base layer comprises a plurality of layers of modules.

17. A method of providing a vehicular trafficked pavement structure comprising:

providing a sub-base layer, said sub-base layer including a plurality of connected, substantially cuboid modules each including spaced-apart, substantially parallel top and bottom walls joined by a peripheral sidewall defining an enclosed substantially hollow volume, the walls comprising apertures to permit the flow of fluid through each of the modules and between the modules, the connection between said modules being effected by a plurality of tie members which prevent lateral movement of the modules relative to one another;

forming a sub-grade;

disposing the sub-base layer directly on the sub-grade, the sub-base layer including a structural layer; and then disposing a plurality of surface layers distinct from the sub-base layer and not comprising modules on top of the sub-base layer to provide a finished surface for vehicular traffic.

18. A method according to claim 17 wherein the sub-base layer comprises a plurality of modules.

19. A method according to claim 18 comprising disposing a geotextile or geomembrane on the sub-grade.

20. A method according to claim 17 comprising disposing a geotextile or geomembrane on top of the sub-base layer.

* * * * *